US008585878B2

(12) United States Patent
Albu et al.

(10) Patent No.: US 8,585,878 B2
(45) Date of Patent: Nov. 19, 2013

(54) METHOD AND APPARATUS FOR CHEMICAL ANALYSIS OF FLUIDS

(75) Inventors: Lucian R. Albu, Forest Hills, NY (US); Hans Zou, Windsor, NJ (US); Jeff Shimizu, Cortlandt Manor, NY (US)

(73) Assignee: MEDIMETRICS Personalized Drug Delivery B.V., Briarcliff Manor, NY (US)

( * ) Notice: Subject to any disclaimer, the term of this patent is extended or adjusted under 35 U.S.C. 154(b) by 611 days.

(21) Appl. No.: 12/673,845

(22) PCT Filed: Aug. 29, 2008

(86) PCT No.: PCT/IB2008/053503

§ 371 (c)(1), (2), (4) Date: Feb. 17, 2010

(87) PCT Pub. No.: WO2009/031088

PCT Pub. Date: Mar. 12, 2009

(65) Prior Publication Data

US 2011/0089050 A1 Apr. 21, 2011

Related U.S. Application Data

(60) Provisional application No. 60/970,279, filed on Sep. 6, 2007.

(51) Int. Cl.
*G01N 27/26* (2006.01)

(52) U.S. Cl.
USPC ..... 204/400; 204/406; 204/416; 204/433; 422/82.02; 324/691; 324/693

(58) Field of Classification Search
USPC ..... 204/401, 404, 406, 416, 433; 205/775; 324/691, 693; 422/82.02
See application file for complete search history.

(56) References Cited

U.S. PATENT DOCUMENTS 3,635,564 A * 1/1972 Zuckerman et al. ..... 356/128
4,935,107 A * 6/1990 Picard et al. ..... 205/782

(Continued)

FOREIGN PATENT DOCUMENTS

JP 11118794 A * 4/1999
WO 9322678 A2 11/1993
WO 2008135930 A1 11/2008

OTHER PUBLICATIONS

Fernandez-Sanchez C. et al., "Electrochemical impedance spectroscopy studies of polymer degradation: application to biosensor development", TRAC: Trends in Analytical Chemistry, Jan. 1, 2005, pp. 37-48, vol. 24, No. 1.

(Continued)

*Primary Examiner* — Jeffrey T Barton
*Assistant Examiner* — Maris R Kessel
(74) *Attorney, Agent, or Firm* — Stephen B. Salai, Esq.; Michael J. Didas, Esq.; Harter Secrest & Emery LLP

(57) ABSTRACT

An apparatus and method for electrochemical fluid analysis comprises a chamber (1202) having a depth dimension for accommodating a volume of a fluid under test, first and second electrodes (A1) disposed within the chamber and extending along the depth dimension in spaced relation with each other, and a soluble solid, such as an annealed polymer, e.g. EUDRAGIT occupying a lateral gap between the first and second electrodes. The rate of dissolution as monitored by electrochemical impedance spectroscopy (EIS) of the soluble solid within the fluid depends on the chemical concentration of a corresponding analyte present in solution in the fluid. In one embodiment a silicon-based integrated circuit device defining an upper margin includes an array of electrodes disposed along said upper margin to permit direct exposure of the electrode array to the fluid under test. The device is constructed using CMOS technology.

20 Claims, 7 Drawing Sheets

(56) References Cited

U.S. PATENT DOCUMENTS

| | | | | |
|---|---|---|---|---|
| 5,140,275 | A * | 8/1992 | Schoerner et al. | 324/693 |
| 2003/0153094 | A1 * | 8/2003 | Alocilja et al. | 436/516 |
| 2004/0038420 | A1 | 2/2004 | Gelbart et al. | |
| 2004/0207384 | A1 | 10/2004 | Brederlow et al. | |

OTHER PUBLICATIONS

McNeil C. J. et al., "Electrochemical sensors based on impedance measurement of enzyme-catalyzed polymer dissolution: theory and applications", Analytical Chemistry, Nov. 1, 1995, pp. 3928-3935, vol. 67, No. 21.

* cited by examiner

METHOD AND APPARATUS FOR CHEMICAL ANALYSIS OF FLUIDS

FIELD OF THE INVENTION

The present invention relates to a system, device and method for measuring the concentration of chemical components present within a fluid and, more particularly, to systems, devices and methods for measuring analyte concentration electrochemically.

BACKGROUND OF THE INVENTION

Chemical concentration of an analyte in a fluid can be measured by transducing presence of the analyte into measurable physical parameters. For example, the concentration of an analyte solution can be determined via such techniques as spectroscopy, chromatography, calorimetry, or optical fluorescence.

Further concentration measurement techniques involve probing the electrical characteristics of the analyte solution. Some such techniques involve coultometry. Others involve amperometric, voltametric, and/or potentiametric titration. Many such techniques are capable of a high degree of accuracy, speed (e.g., throughput), and efficiency. Unfortunately, the equipment required to implement such techniques can tend to be both large and bulky. As a result, the use of such equipment is typically limited to a laboratory setting, and technicians in the field who seek to make concentration determinations via measurement of electrical characteristics are often left with few attractive options.

Despite efforts to date, a need remains for effective methods and systems for electrochemical measurement of analyte concentration, particularly for applications in which a high premium is placed on portability and field use availability. These and other needs are satisfied by the methods and systems disclosed herein.

SUMMARY OF THE INVENTION

Apparatus and methods for electrochemical analysis of fluids are provided according to the present disclosure.

In an exemplary embodiment of the present disclosure, an apparatus is provided that includes a chamber having a depth dimension for accommodating a volume of a fluid under test, a first electrode disposed within the chamber and extending therewithin along the depth dimension, a second electrode disposed within the chamber and extending therewithin along the depth dimension in laterally spaced relation with the first electrode, and a soluble solid disposed within the chamber between the first and second electrodes so as to substantially completely occupy a lateral gap therebetween to an extent of at least a portion of the depth dimension. A rate of dissolution of the soluble solid within the fluid is at least partially dependent on a chemical concentration of a corresponding analyte present in solution in the fluid.

A method for electrochemical analysis of fluids is also provided. In exemplary embodiments of the present disclosure, the method includes exposing a soluble solid to a fluid, measuring a rate of dissolution of the soluble solid in the fluid, and determining a chemical concentration of a corresponding analyte present in solution in the fluid based on the measured rate of dissolution.

Additional advantageous features, functions and applications of the disclosed apparatus and methods for electrochemical analysis of fluids will be apparent from the description which follows, particularly when read in conjunction with the appended figures.

BRIEF DESCRIPTION OF THE DRAWINGS

To assist those of skill in the art in making and using the disclosed systems and methods, reference is made to the accompanying figures, wherein.

DETAILED DESCRIPTION OF THE INVENTION

Figure 1:
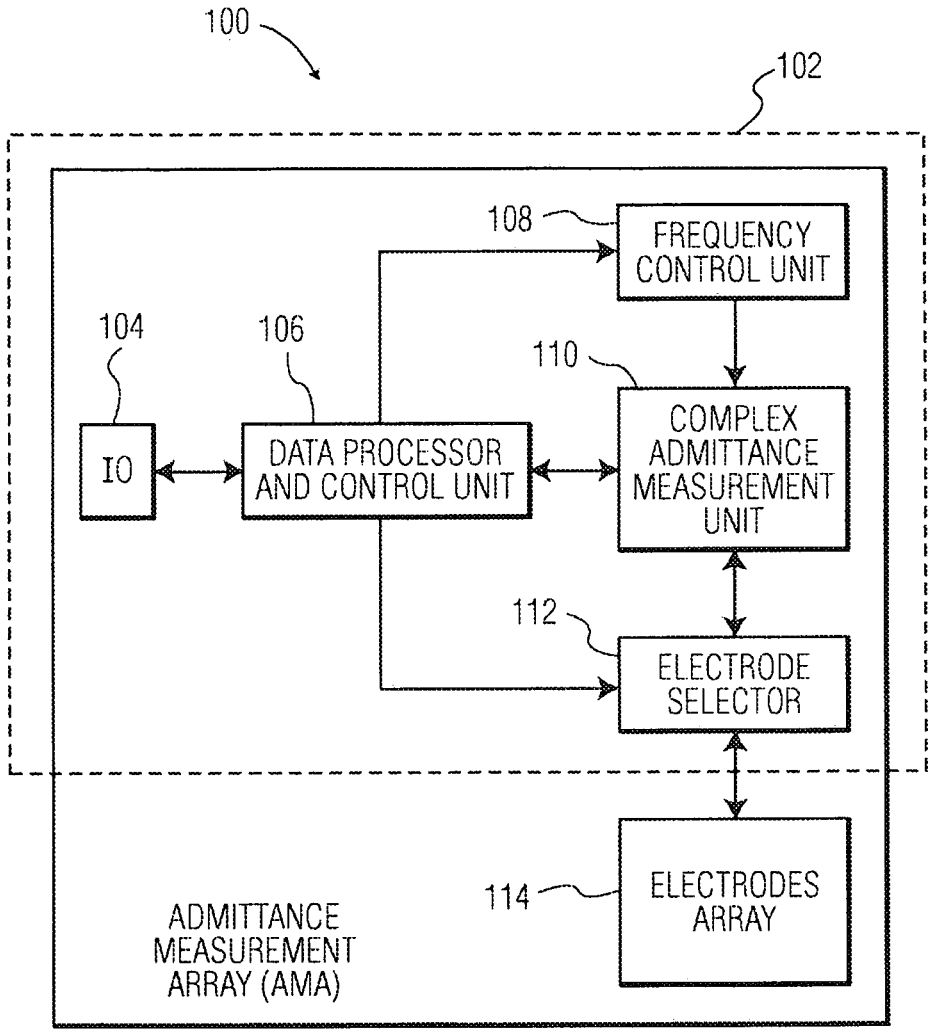
FIG. 1 is a schematic representation of an embodiment of an analyte concentration measurement tool in accordance with the present disclosure.

An apparatus for electrochemical analysis of fluids is provided that can be adapted to be compact in size, economic to manufacture, and convenient to deploy. Exemplary embodiments of apparatus for electrochemical analysis of fluids include a chamber having a depth dimension for accommodating a volume of a fluid under test, and a pair of electrodes disposed within the chamber and extending along the depth dimension thereof in laterally spaced relation to each other. A soluble solid is disposed within the chamber between the electrodes, occupying a lateral gap therebetween to an extent of at least a portion of the depth dimension of the chamber. A rate of dissolution of the soluble solid within the fluid is at least partially dependent on a chemical concentration of a corresponding analyte present in solution in the fluid To the extent that the soluble solid dissolves in the fluid, the fluid fills the void generated by the dissolving solid. Because the soluble solid is a poorer conductor compared to the fluid, dissolution of the soluble solid leads to an increase of conductance between the electrodes. The rate of conductance change further depends on the properties of the dissolving solid and the actual analyte concentration in solution in the fluid.

Materials suitable for use with respect to the soluble solid according to the present disclosure include commercially available materials that exhibit respective solubilities dependent on the concentration in solution of a chemical component or active species of interest, e.g., H+ concentration (i.e., pH), proteins, amino acids, glucose, enzymes and other analytes of interest. Exemplary materials for use with respect to the soluble solid according to the present disclosure include polymers that exhibit a pH-dependent dissolution rate, such as EUDRAGIT acrylic polymers manufactured by Degussa GmbH, and polymers that exhibit dissolution rates that are dependent on the presence of colon enzyme, such as azo polymers used by Alizyme plc (Cambridge, United Kingdom).

Apparatus and methods for electrochemical analysis of fluids in accordance with the present disclosure may be used to measure the concentration for a large number of chemical components present within a fluid under test. In embodiments of the present disclosure, such apparatus and methods rely on polymers with specific solubility depending on concentration of compounds mixed within the fluid, and include an electronic device that allows an accurate measurement of the solubility based upon complex conductance measurements. The lifetime of the electronic device may be limited in accordance with embodiments of the present disclosure, and controlled by processing parameters of the device.

In accordance with some embodiments of the present disclosure, a small, simple, energy efficient 'lab-on-a-chip' solution is provided having a response time in the field at least comparable to, if not superior to, many larger, more bulky systems commonly limited to use within a laboratory. Such an apparatus can be implemented through the use of an integrated circuit (IC) electronic device combined with an array of confined micro-cylinders fabricated via MEMS processes at the surface of a die associated with the IC electronic device, and filled with polymers having known etching rate versus chemical concentration of active species in solution in the fluid under test.

For illustration purposes, the disclosed apparatus and methods are described in greater detail herein with reference to a tool for measuring analyte concentration in solution in a fluid under test. However, the disclosed systems and methods have wide ranging applicability, as will be readily apparent to persons skilled in the art, including implementations directed to a variety of analytes. Thus, in one exemplary embodiment of the present disclosure, the apparatus includes a soluble solid in the form of a polymer that does not dissolve until the pH is above a threshold value and, as a result, the conductance between the electrodes does not increase unless the fluid under test has a pH above this threshold. If the pH of the fluid under test is above the applicable threshold, the conductance between electrodes will advantageously increase proportionally to the difference between the actual pH value of the fluid under test and the lower threshold pH of the soluble polymer.

Additionally, in one exemplary embodiment of the present disclosure, the apparatus includes a soluble solid in the form of a polymer that does not dissolve unless the pH of the fluid under test is below a threshold value and, as a result, the conductance between the electrodes does not increase unless the fluid under test has a pH below this threshold. If the pH of the fluid under test is below the applicable threshold, the conductance between electrodes will advantageously increase proportionally to the difference between the actual pH value of the fluid under test and the higher threshold pH of the soluble polymer. Therefore, by monitoring a rate of change in conductance between the electrodes between which the soluble solid is disposed, either or both of a pH limit value and an actual pH value can be derived.

When an apparatus for electrochemically analyzing a fluid based on this principle of concentration-dependent solubility is used, conductance between each pair of electrodes may be measured as a function of time, and the rate of conductance change may be used to derive the concentration value of the analyte present in solution in the fluid under test. One unique advantage of such an apparatus for electrochemically analyzing a fluid is that the apparatus can be operated without absolute calibration. Variation in manufacturing process and environmental conditions, such as overall conductivity of the fluids under test, can cause variation in absolute conductance between electrodes. These variations, however, do not interfere with derivation of the concentration value of an analyte present in solution in a fluid under test because the concentration value is determined by the change rate of conductance, not by the absolute value of conductance. Of course, such an apparatus can be used in conjunction with a reference electrode to account for environmental changes in the rate of conductance.

An apparatus 100 for measuring analyte concentration in solution in a fluid under test in accordance with embodiments of the present disclosure is shown in FIG. 1. The apparatus 100 may include a silicon-based integrated circuit (IC) 102. The IC 102 may incorporate an input/output (IO) data block 104, a data processor and control unit (DPCU) 106, an amplitude and frequency control unit (AFCU) 108, a complex admittance measurement unit (CAMU) 110, and an electrode selector (ES) 112. The apparatus 100 may further include an electrode array (EA) 114.

The IO 104 may be an interface of the circuit with respect to external devices. The EA 114 is a matrix of electrodes present at an upper margin or surface of the IC 102. Each of the electrodes of the EA 114 can be connected through the ES 112 block to corresponding measurement ports of the CAMU 110. All other electrodes of the EA 114 may be grounded. The ES 112 may be an array of analog switches which allows the selection of a single electrode out of the EA 114. The CAMU 110 can measure the complex admittance of the circuit connected at the selected electrode from the EA 114. The frequency and amplitude of the test signal can be controlled and/or imposed by the AFCU 108. The DPCU 106 may receive analog signals provided by the CAMU 110 and convert the same to digital values. The DPCU 106 may further store and/or process such digital values, take decisions regarding the frequencies and amplitudes of operations from the AFCU 108 and operate the ES 112 accordingly. The DPCU 106 may further be employed to transfer to the IO 104 measurement results with respect to concentration(s) of one or more analytes present in solution in the fluid under test.

Figure 2:
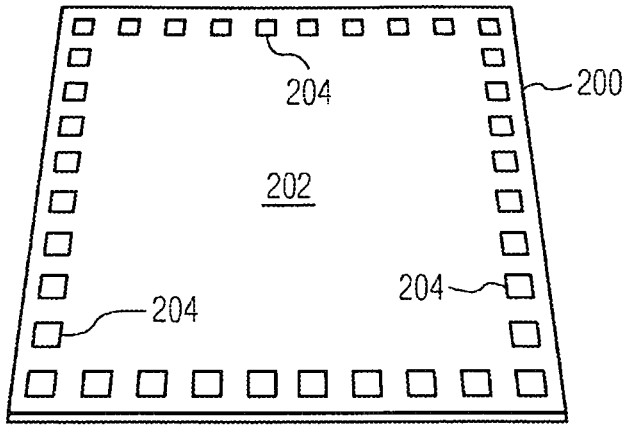
FIG. 2 is a downward perspective view of a CMOS die useable to fabricate the FIG. 1 measurement tool in accordance with the present disclosure.

In accordance with embodiments of the present disclosure, the CMOS die 200 shown in FIG. 2 can embody the FIG. 1 IC 102. For example, the CMOS die 200 may include an upper margin 202 featuring an array of peripherally-disposed contacts 204 associated with an input/output interface of the circuit (e.g., associated with the FIG. 1 IO 104).

A MEMS process may be utilized to modify and/or convert the CMOS die 200 of FIG. 2 to form an embodiment of the FIG. 1 apparatus 100 in accordance with the present disclosure. An example of such a process is shown and described below with reference to FIGS. 3-13.

Figure 3:
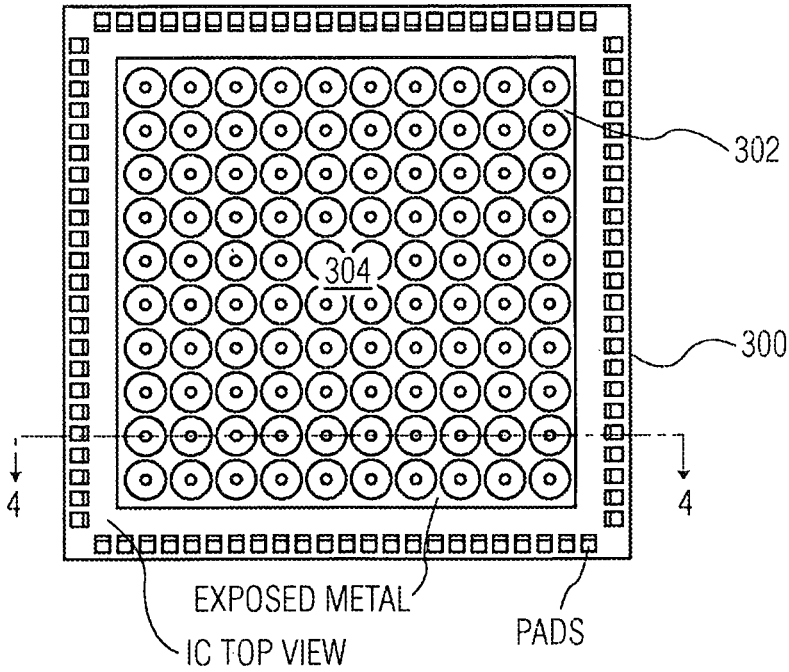
FIG. 3 is a top plan view of the FIG. 2 CMOS die after modification via formation on an upper margin thereof of a metallic contact pattern in accordance with the present disclosure.
Figure 4:
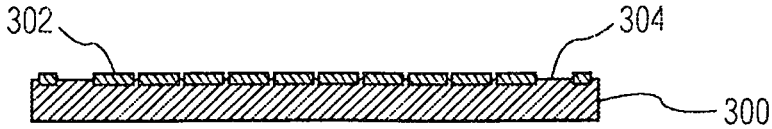
FIG. 4 is a section view of the FIG. 3 modified CMOS die taken along section line 4-4 shown in FIG. 3.
Figure 5:
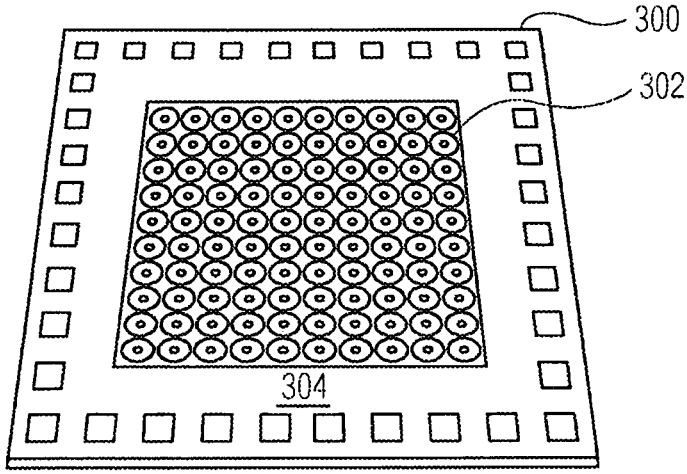
FIG. 5 is a downward perspective view of the FIG. 3 modified CMOS die.

Referring now to FIGS. 3, 4 and 5, a modified CMOS die 300 can be formed by modifying the FIG. 2 CMOS die 102 via conventional metal deposition process and associated appropriate patterning to form a contact pattern 302 on an upper margin 304 of the die 300 operative to permit electrical interconnection between an IC (e.g., FIG. 1 IC 102) and an electrode array (e.g., FIG. 1 EA 114) in accordance with the present invention.

Figure 6:
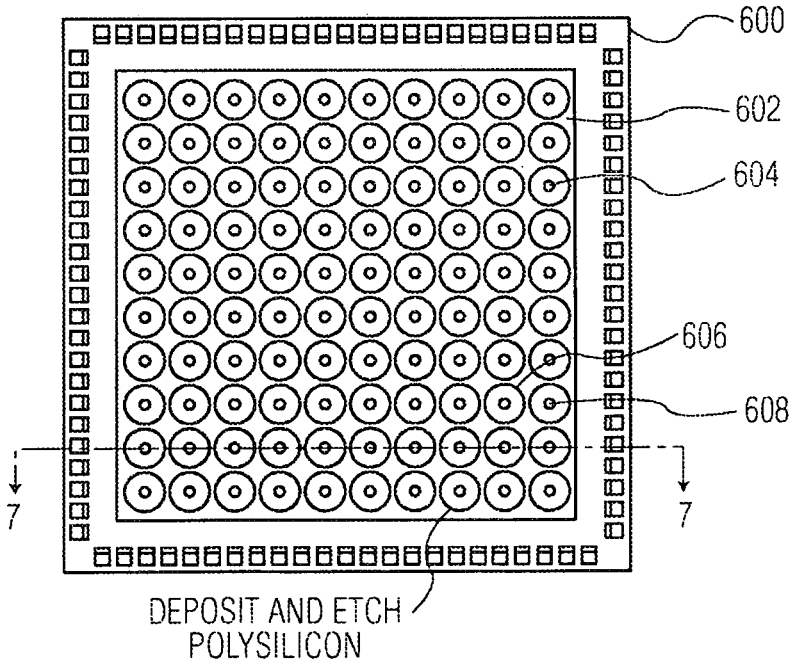
FIG. 6 is a top plan view of the FIG. 3 modified CMOS die after further modification via formation atop the metallic contact pattern thereof of an array of paired electrodes in accordance with the present disclosure.
Figure 7:
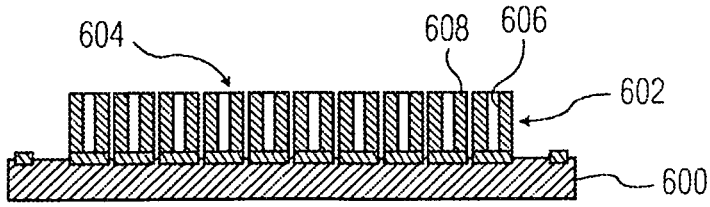
FIG. 7 is a section view of the FIG. 6 modified CMOS die taken along section line 7-7 shown in FIG. 6.
Figure 8:
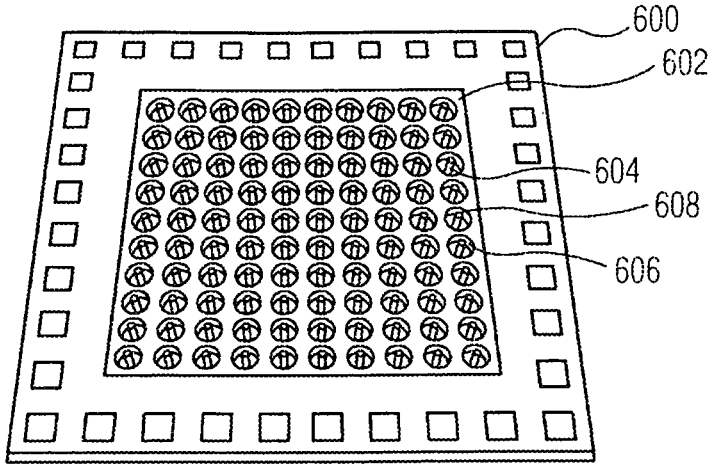
FIG. 8 is a downward perspective view of the FIG. 6 modified CMOS die.

Referring now to FIGS. 6, 7 and 8, a modified CMOS die 600 can be formed by further modifying the FIG. 3 modified CMOS die 300 via an appropriate aluminum-silicon deposition and etch processes (e.g., with a highly selective RIE) to form a mask 602. The mask 602 may include an array of chambers 604 for accommodating small volumes of a liquid under test, each of which may include a cylindrically shaped microbarrel 606 connected to ground and a column shaped central electrode 608. The central electrodes 608 may be disposed within the microbarrels 606, and, further may be coaxial with, and/or coextensive (e.g., depthwise) therewith.

Figure 9:
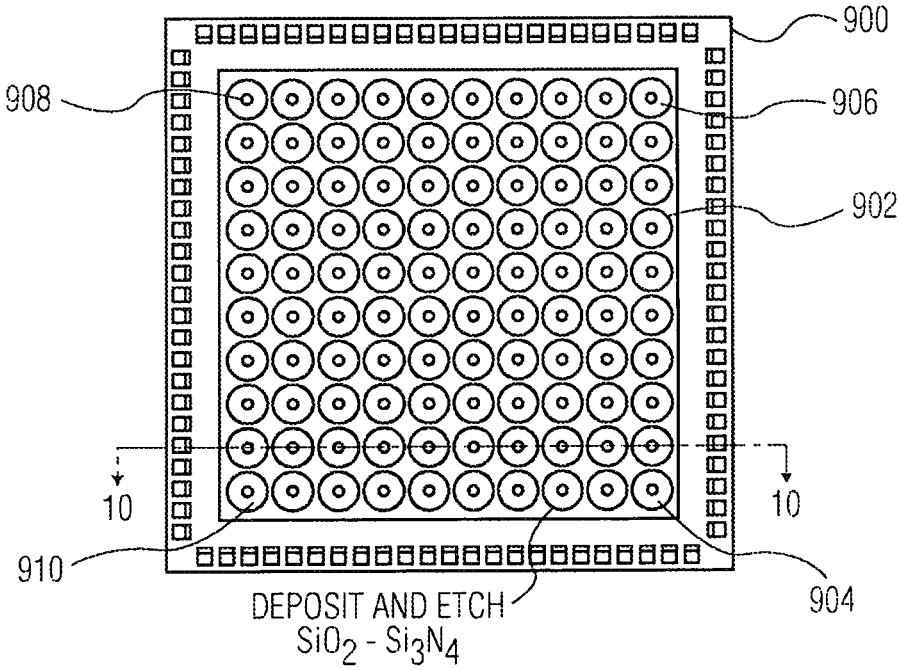
FIG. 9 is a top plan view of the FIG. 6 modified CMOS die after further modification via formation atop the array of paired electrodes thereof of a dielectric material layer in accordance with the present disclosure.
Figure 10:
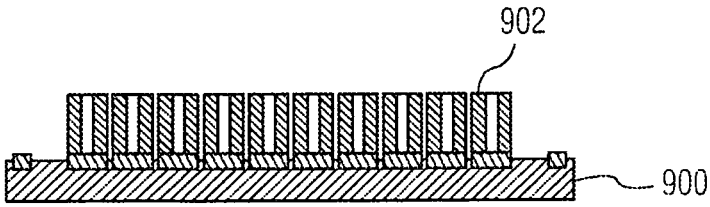
FIG. 10 is a section view of the FIG. 9 modified CMOS die taken along section line 10-10 shown in FIG. 9.
Figure 11:
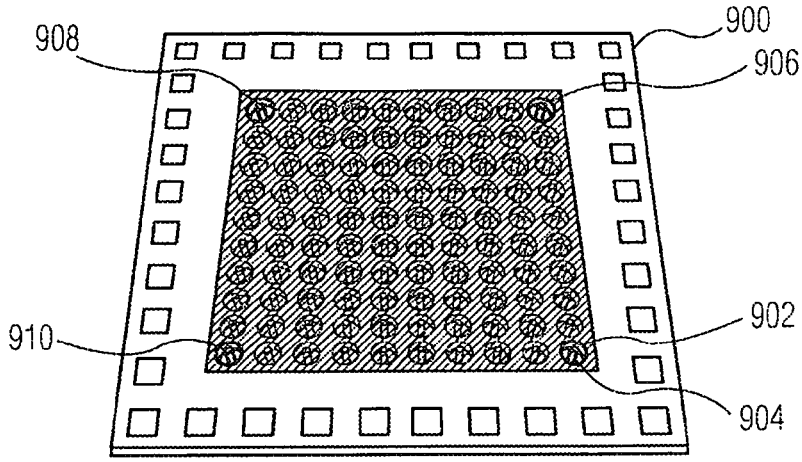
FIG. 11 is a downward perspective view of the FIG. 9 modified CMOS die.

Referring now to FIGS. 9, 10 and 11, a modified CMOS die 900 can be formed by further modifying the FIG. 6 modified CMOS die 600 via an appropriate material layer deposition and etch process, e.g., to form a dielectric material layer 902 atop the FIG. 6 mask 602. For example, the dielectric material layer 902 may be a $SiO_2$-$Si_3N_4$ layer. One or more of the FIG. 6 chambers 604 may be masked during this step so as to prevent the dielectric material layer 902 from extending thereto. For example, four such chambers (e.g., chambers lacking a layer 902 of a dielectric material) may be positioned on respective corners 904, 906, 908, 910 of the die 900, and/or may be used to measure air admittance (e.g., as part of a measurement control function).

Figure 12:
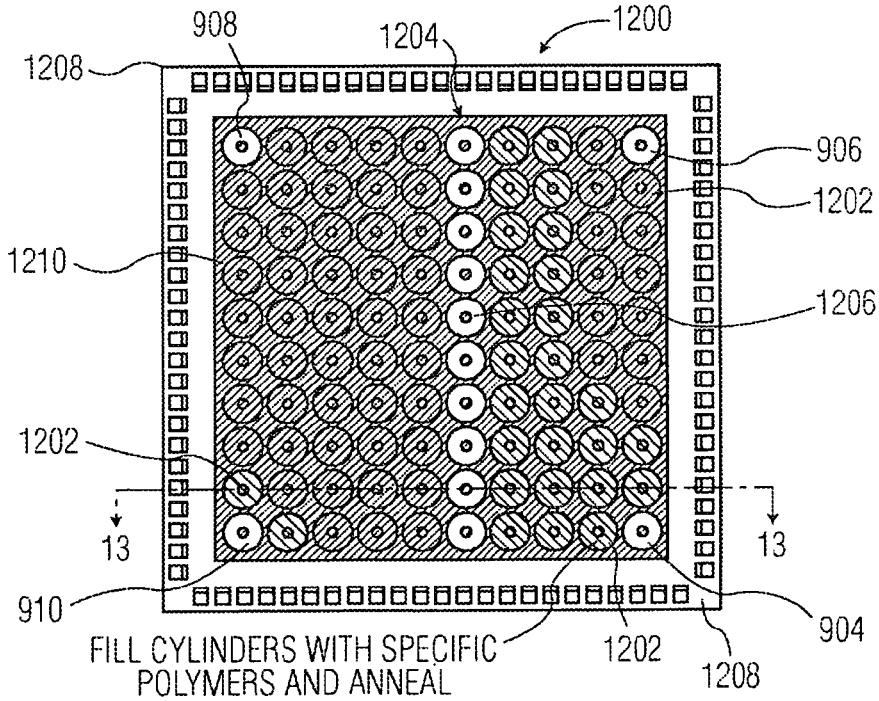
FIG. 12 is a top plan view of the FIG. 9 modified CMOS die after filling of the cylindrical chambers thereof with polymeric materials and associated annealing to form an embodiment of the analyte concentration measurement tool of FIG. 1 in accordance with the present disclosure.
Figure 13:
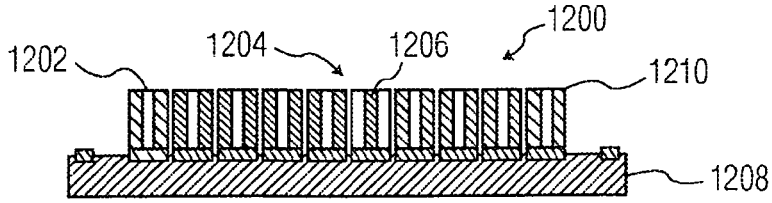
FIG. 13 is a section view of the FIG. 12 analyte concentration measurement tool.

Referring now to FIGS. 12 and 13, an analyte concentration measurement tool 1200 is shown. For example, the tool 1200 may be implemented to embody the analyte concentration measurement tool 100 of FIG. 1. The tool 1200 can be formed by further modifying the FIG. 9 modified CMOS die 900 via filling one or more of the FIG. 6 chambers 604 with similar and/or different polymers and executing an appropriate annealing process to form fluid-polymer filled cylinders or chambers 1202 (described further hereinbelow), wherein the dissolution rate of each such polymer may be specific to one or more of the same or different chemical compounds in solution in a fluid under test. The FIG. 9 corner-disposed chambers 904, 906, 908, 910 may be left unfilled with polymer for purposes of measuring air admittance as part of a measurement control function. Likewise, an entire row 1204 of chambers 1206, also referred to herein as fluid filled cylinders or chambers 1206, may be left unfilled with polymer for purposes of measuring an admittance of the fluid under test as described more fully below.

The tool 1200 includes an IC 1208 which can embody, for example, the FIG. 1 IC 102, and a MEMS region 1210 which can embody the FIG. 1 EA 114. The MEMS region 1210 can be configured to be exposed to the fluid under test, while the IC 1208 can be configured such that its internally-disposed electrical circuitry and/or functions are secured from damage from the fluid under test.

Figure 14:
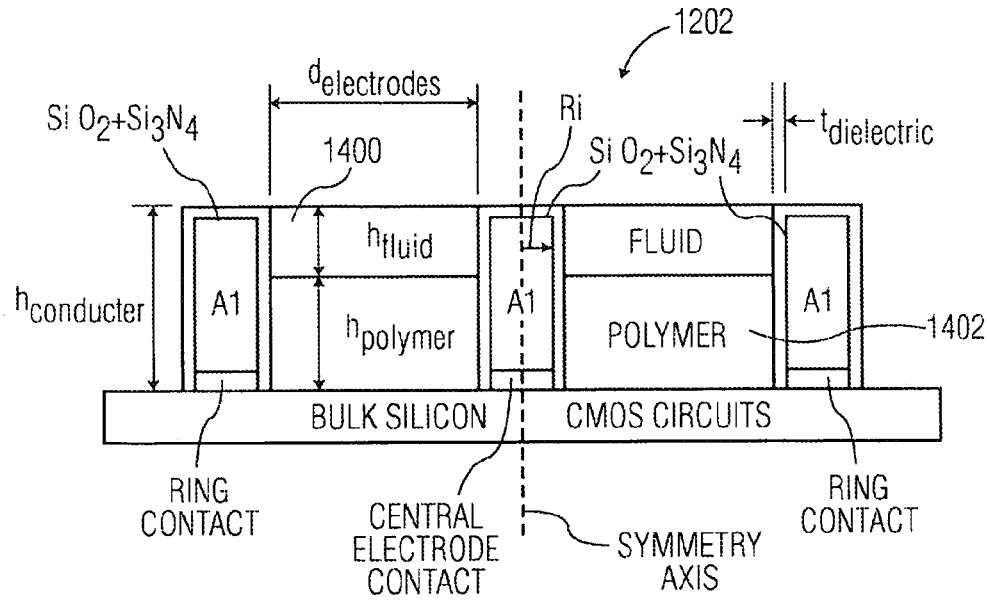
FIG. 14 is a section view of a fluid-polymer filled cylinder of the FIG. 12 analyte concentration measurement tool in accordance with the present disclosure.
Figure 15:
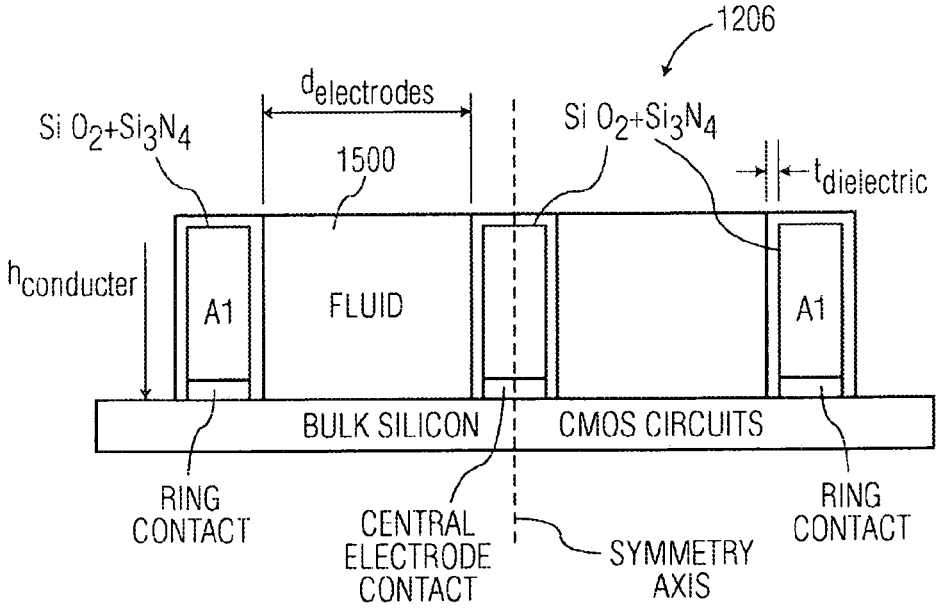
FIG. 15 is a section view of a fluid filled cylinder of the FIG. 12 analyte concentration measurement tool in accordance with the present disclosure.

Referring now to FIG. 14, when exposed to fluid 1400 from the fluid under test, the soluble solid 1402 (e.g., polymer) within the chamber 1202 is dissolved by the analyte present in solution in the fluid under test. FIG. 14 gives a vertical plane cross-section through a fluid-polymer filled cylinder (FPC) 1202 after the soluble solid 1402 contained therein was etched to an etch value equal to $h_{fluid}$. FIG. 15 gives a vertical plane cross-section through a fluid filled cylinder (FC) 1206. When exposed to the fluid under test, the fluid-filled cylinders 1206, containing no soluble solid (e.g., containing no polymer), are filled with fluid 1500. The FIG. 12 tool 1200 measures the complex admittances for all of the FPCs 1202 and FCs 1206 of the MEMS region 1210 at specific time intervals and estimates the electrical properties of polymers within the FPCs 1202 and the fluid within the FCs 1206 and the etch rate for every type of polymer from every FPC 1202. Based on the etching rate, one may determine the concentrations of active chemical species within the fluid under test. The capacity to make such determinations may last as long as the polymers within the FPCs 1202 are not completely dissolved within the fluid under test.

Figure 16:
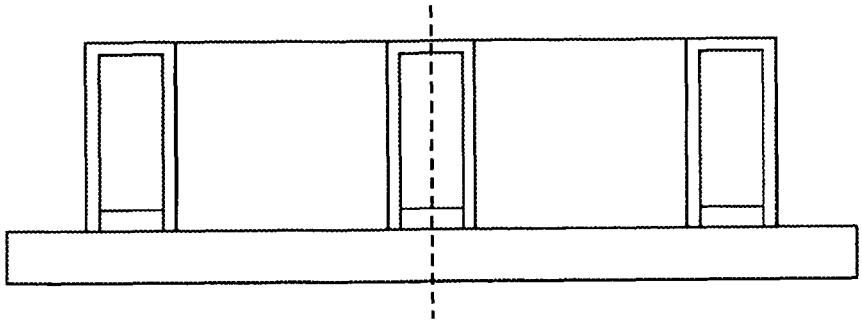
FIG. 16 is a schematic diagram of an exemplary electrical circuit corresponding to the fluid-polymer filled cylinder of FIG. 14.
Figure 17:
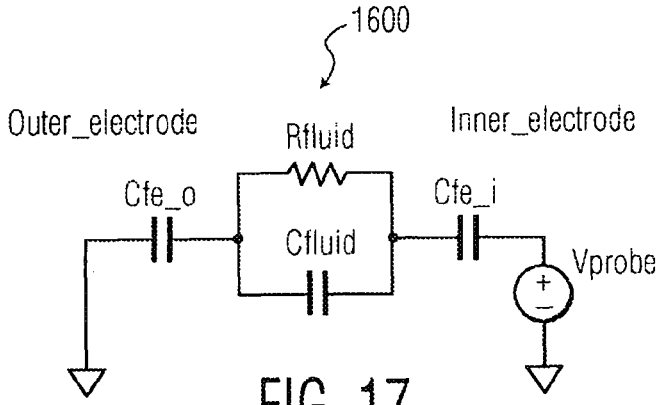
FIG. 17 is a schematic diagram of an exemplary electrical circuit corresponding to the fluid-filled cylinder of FIG. 15.
Figure 18:
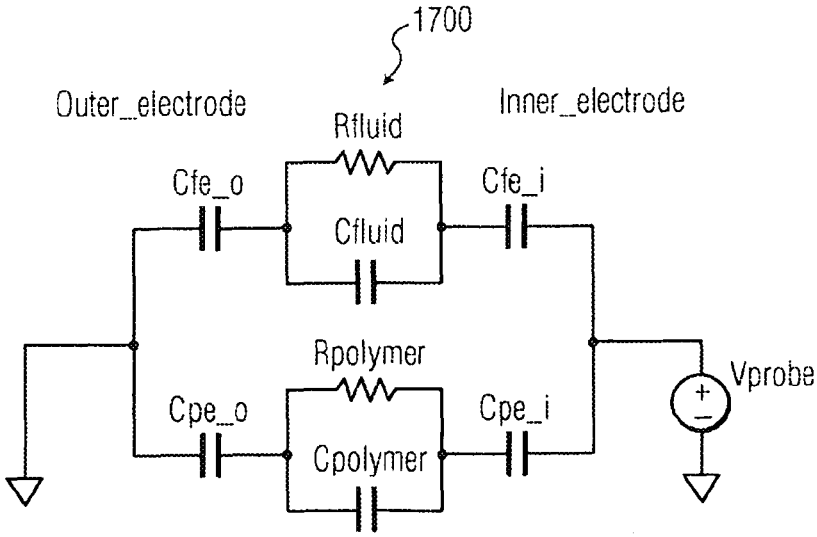
FIG. 18 is a schematic diagram of an exemplary electrical circuit.

Exemplary electric equivalent circuits 1600, 1700 for FPCs 1202 and FCs 1206 are given, respectively, in FIGS. 16 and 17.

The below-described algorithm is executable by a processor (e.g., by the FIG. 1 DPCU 106) in accordance with the present disclosure to allow the determination at a time tj of the concentration of species present in solution in the fluid under test, given the FPC 1202 are filled with different polymers with etching rates specific to every chemical concentration of the species.

$V_{probe}$ is a voltage source $V_{probe}=V_0e^{i(\omega t+\phi)}$ with $i=\sqrt{-1}$, $V_0$: amplitude, ω: angular frequency, ϕ: phase, t: time. The complex impedeance of the circuit from FIG. 8 (seen by the voltage source voltage source $V_{probe}$ is:

$$Z_g = \frac{\left(X_{Cfe_i} + X_{Cfe_o} + \frac{X_{Cfluid}R_{fluid}}{X_{Cfluid}R_{fluid}}\right)\left(X_{Cpe_i} + X_{Cpe_o} + \frac{X_{Cpolymer}R_{polymer}}{X_{Cpolymer}+R_{polymer}}\right)}{X_{Cfe_i} + X_{Cfe_o} + X_{Cpe_i} + X_{Cpe_o} + \frac{X_{Cfluid}R_{fluid}}{X_{Cfluid}+R_{fluid}} + \frac{X_{Cpolymer}R_{polymer}}{X_{Cpolymer}+R_{polymer}}} \quad (1)$$

where:

$$X_{Cfe_i} = \frac{1}{i\omega C_{fe_i}},\ X_{Cfe_o} = \frac{1}{i\omega C_{fe_o}},$$
$$X_{Cpe_o} = \frac{1}{i\omega C_{pe_o}},\ X_{Cpe_i} = \frac{1}{i\omega C_{pe_i}},$$
$$X_{Cpolymer} = \frac{1}{i\omega C_{polymer}},\ X_{Cfluid} = \frac{1}{i\omega C_{fluid}} \quad (2)$$

And the resistors are not frequency dependent (the voltage source frequency is smaller than the minimum ionic rotation frequency within the fluid or polymer).

Capacitances and resistances are calculated with the coaxial model. As a reminder:

the resistance measured between the inner electrode with radius $R_i$ and output electrode with radius $R_o$ of a coaxial cable of length l filled with a material of resistivity ρ is:

$$R(l) = \frac{\rho \ln \frac{R_o}{R_i}}{2\pi l} \tag{3}$$

the capacitance measured between the inner electrode with radius $R_i$ and output electrode with radius $R_o$ of a coaxial cable of length l filled with a material with a relative dielectric constant $\epsilon_{dielectric}$ is:

$$C(l) = \frac{2\pi\varepsilon_{dielectric}\varepsilon_0 l}{\ln \frac{R_o}{R_i}} \tag{4}$$

Interestingly enough, the time constant associated to this coax cable is independent of any geometrical parameters of the cable:

$$\tau = R(l)C(l) = \epsilon_{dielectric}\epsilon_0\rho \tag{5}$$

We will use the following notations:

$$\begin{aligned}
&h_{electrodes} = h_{conductor} \\
&\varepsilon'_{dielectric} = 2\pi\varepsilon_{dielectric}\varepsilon_0,\ \varepsilon'_{fluid} = 2\pi\varepsilon_{fluid}\varepsilon_0, \\
&\varepsilon'_{polymer} = 2\pi\varepsilon_{polymer}\varepsilon_0 \\
&\rho'_{fluid} = \frac{\rho_{fluid}}{2\pi},\ \rho'_{polymer} = \frac{\rho_{polymer}}{2\pi} \\
&\tau_{polymer} = \varepsilon_0\rho_{polymer}\varepsilon_{polymer} = \varepsilon'_{polymer}\rho'_{polymer}, \\
&\tau_{fluid} = \varepsilon_0\rho_{fluid} = \varepsilon'_{fluid}\rho'_{fluid} \\
&\xi = \frac{h_{fluid}}{h_{electrodes}}
\end{aligned} \tag{6}$$

The expressions for the capacitances instantiated by equations (2) are:

$$\begin{aligned}
C_{e_i} &= \frac{\varepsilon'_{dielectric}}{\ln\left(1 + \frac{t_{dielectric}}{R_i}\right)} h_{electrodes} \\
C_{e_o} &= \frac{\varepsilon'_{dielectric}}{\ln\left(1 + \frac{t_{dielectric}}{R_i + t_{dielectric} + d_{electrodes}}\right)} h_{electrodes} \\
C_{fe_i}(h_{fluid}) &= \frac{\varepsilon'_{dielectric}}{\ln\left(1 + \frac{t_{dielectric}}{R_i}\right)} h_{fluid} \\
&= \xi C_{fe_i}(h_{electorodes}) = \xi C_{e_i} \\
C_{fe_o}(h_{fluid}) &= \frac{\varepsilon'_{dielectric}}{\ln\left(1 + \frac{t_{dielectric}}{R_i + t_{dielectric} + d_{electrodes}}\right)} h_{fluid} \\
&= \xi C_{fe_o}(h_{electrodes}) \\
&= \xi C_{e_o} \\
C_{pe_i}(h_{fluid}) &= \frac{\varepsilon'_{dielectric}}{\ln\left(1 + \frac{t_{dielectric}}{R_i}\right)} (h_{electrodes} - h_{fluid}) \\
&= (1-\xi) C_{pe_i}(h_{electrodes}) \\
&= (1-\xi) C_{e_i}
\end{aligned} \tag{7}$$

-continued $$\begin{aligned}
C_{pe_i}(h_{fluid}) &= \frac{\varepsilon'_{dielectric}}{\ln\left(1 + \frac{t_{dielectric}}{R_i + t_{dielectric} + d_{electrodes}}\right)} (h_{electrodes} - h_{fluid}) \\
&= (1-\xi) C_{pe_o}(h_{electrodes}) \\
&= (1-\xi) C_{e_o}
\end{aligned}$$

$$\begin{aligned}
C_{fluid}(h_{fluid}) &= \frac{\varepsilon'_{fluid}}{\ln\left(1 + \frac{d_{electrodes}}{R_i + t_{dielectric}}\right)} h_{fluid} \\
&= \xi C_{fluid}(h_{electrodes}) \\
&= \xi C_{FC,fluid}
\end{aligned}$$

$$\begin{aligned}
C_{polymer}(h_{fluid}) &= \frac{\varepsilon'_{fluid}}{\ln\left(1 + \frac{d_{electrodes}}{R_i + t_{dielectric}}\right)} (h_{electrodes} - h_{fluid}) \\
&= (1-\xi) C_{polymer}(h_{electrodes}) \\
&= (1-\xi) C_{FPC,polymer,0}
\end{aligned}$$

All capacitances are linear functions of $h_{fluid}$

The expressions for the resistances instantiated by equations (2) are:

$$\begin{aligned}
R_{fluid}(h_{fluid}) &= \frac{\rho'_{fluid} \ln\left(1 + \frac{d_{electrodes}}{R_i + t_{dielectric}}\right)}{h_{fluid}} \\
&= \frac{R_{fluid}(h_{electrodes})}{\xi} \\
&= \frac{R_{FC,fluid}}{\xi}
\end{aligned} \tag{8}$$

$$\begin{aligned}
R_{polymer}(h_{fluid}) &= \frac{\rho'_{polymer} \ln\left(1 + \frac{d_{electrodes}}{R_i + t_{dielectric}}\right)}{h_{electrodes} - h_{fluid}} \\
&= \frac{R_{polymer}(h_{electrodes})}{1-\xi} \\
&= \frac{R_{FPC,polymer,0}}{1-\xi}
\end{aligned}$$

All conductances are linear functions of $h_{fluid}$

Step 1: Device in Air

FPC filled with polymer only

FC filled with air

Test cylinders filled with air.

Measuring the admittance $\tilde{Y}_{C,test,air}$ of the test cylinders in the air ($\epsilon_{air}=1$) allows the experimental determination of the thickness of the dielectrics within the FPC and FC:

$$\begin{aligned}
\tilde{Y}_{C,test,air} &= i\omega C_{test} \\
&= i\omega \frac{2\pi\varepsilon_0}{\ln\left(1 + \frac{2t_{dielectric} + d_{electrodes}}{R_i}\right)} h_{electrodes} \Leftrightarrow t_{dielectric} \\
&= \frac{1}{2}\left(R_i\left(e^{\frac{2\pi\varepsilon_0 w h_{electrodes}}{\Im(\tilde{Y}_{C,test,air})}} - 1\right) - d_{electrodes}\right)
\end{aligned} \tag{9}$$

The admittance of the FC filled with air is ($\rho_{air}\approx\infty$, $\epsilon_{air}=1$)

$$\frac{i\omega h_{electrodes}}{\tilde{Y}_{C,test,air}}=\left(\frac{1}{\varepsilon'_{dielectric}}\ln\left(1+\frac{t_{dielectric}}{R_i}\right)+\frac{1}{\varepsilon'_{air}}\ln\left(1+\frac{d_{electrodes}}{R_i+t_{dielectric}}\right)+\frac{1}{\varepsilon'_{dielectric}}\ln\left(1+\frac{t_{dielectric}}{R_i+t_{dielectric}+d_{electrodes}}\right)\right)\Leftrightarrow$$

$$\varepsilon'_{dielectric}=\frac{\ln\left(\left(1+\frac{t_{dielectric}}{R_i}\right)\left(1+\frac{t_{dielectric}}{R_i+t_{dielectric}+d_{electrodes}}\right)\right)}{\frac{\omega h_{electrodes}}{\Im(\tilde{Y}_{C,test,air})}-\frac{1}{\varepsilon'_{air}}\ln\left(1+\frac{d_{electrodes}}{R_i+t_{dielectric}}\right)}$$

The measurements performed in air allowed the determinations of two critical values: $\epsilon_{dielectric}$ and $t_{dielectric}$ Let us measure the FPC in air ($h_{fluid}=0$):

$$\tilde{Z}_{g,FPC,air}=X_{Cpe_i}+X_{Cpe_o}+\frac{X_{Cpolymer}R_{polymer}}{X_{Cpolymer}+R_{polymer}}\Leftrightarrow \tag{11}$$

$$\tilde{Z}_{g,FPC,air}-(X_{Cpe_i}+X_{Cpe_o})=\frac{R_{polymer}(0)}{1+i\omega R_{polymer}(0)C_{polymer}(0)}$$

Replace the values for $X_{Cpe_i}$ and $X_{Cpe_o}$ with the expression given in (7) for $h_{fluid}=0$:

$$\tilde{Z}_{g,FPC,air}-\frac{1}{i\omega}\left(\frac{1}{C_{pe_i}(0)}+\frac{1}{C_{pe_o}}\right)=\frac{R_{polymer}(0)}{1+i\omega R_{polymer}(0)C_{polymer}(0)}\Leftrightarrow \tag{12}$$

$$\Re(\tilde{Z}_{g,FPC,air})+i\Im(\tilde{Z}_{g,FPC,air})+\frac{i}{\omega}\left(\frac{1}{C_{pe_i}(0)}+\frac{1}{C_{pe_o}(0)}\right)=\frac{(1-i\omega\tau_{polymer})R_{polymer}(0)}{1+\omega^2\tau_{polymer}^2}\Leftrightarrow$$

$$\begin{cases}\Re(\tilde{Z}_{g,FPC,air})=\dfrac{R_{polymer}(0)}{1+\omega^2\tau_{polymer}^2}\\ \Im(\tilde{Z}_{g,FPC,air})+\dfrac{1}{\omega}\left(\dfrac{1}{C_{pe_i}(0)}+\dfrac{1}{C_{pe_o}(0)}\right)=\dfrac{-\omega\tau_{polymer}R_{polymer}(0)}{1+\omega^2\tau_{polymer}^2}\end{cases}\Leftrightarrow$$

$$\begin{cases}\Re(\tilde{Z}_{g,FPC,air})=\dfrac{R_{polymer}(0)}{1+\omega^2\tau_{polymer}^2}\\ \Im(\tilde{Z}_{g,FPC,air})+\dfrac{1}{\omega}\left(\dfrac{1}{C_{pe_i}(0)}+\dfrac{1}{C_{pe_o}(0)}\right)=-\omega\tau_{polymer}\Re(\tilde{Z}_{g,FPC,air})\end{cases}\Leftrightarrow$$

$$\begin{cases}\tau_{polymer}=\dfrac{\dfrac{1}{C_{pe_i}(0)}+\dfrac{1}{C_{pe_o}(0)}+\omega\Im(\tilde{Z}_{g,FPC,air})}{\omega^2\Re(Z_{g,FPC,air})}\\ R_{polymer}(0)=(1+\omega^2\tau_{polymer}^2)\Re(\tilde{Z}_{g,FPC,air})\end{cases}\Leftrightarrow$$

Step 2: Measure the Fluid and Polymer Admittance at any Time after the Device has been Immersed in a Fluid.

Assume the fluid etched the polymer, and got to the coordinate $h_{fluid}$ of the FPC.

The FC complex admittance yields:

$$\begin{cases}\tau_{fluid}=-\dfrac{\dfrac{1}{C_{pe_i}(0)}+\dfrac{1}{C_{pe_o}(0)}+\omega\Im(\tilde{Z}_{g,FC})}{\omega^2\Re(Z_{g,FC})}\\ R_{fluid}(0)=(1+\omega^2\tau_{fluid}^2)\Re(\tilde{Z}_{g,FC})\end{cases}\Leftrightarrow \tag{13}$$

The FPC complex admittance yields:

$$X(h_{fluid})+X(h_{fluid})+\frac{X_{Cfluid}(h_{fluid})R_{fluid}(h_{fluid})}{X_{Cfluid}(x)+R_{fluid}(x)}=\frac{1}{\xi}\left(X_{C,FC,fe_i}+X_{C,FC,fe_o}+\frac{X_{C,FC,fluid}R_{FC,fluid}}{X_{C,FC,fluid}+R_{FC,fluid}}\right)=\frac{1}{\xi}\tilde{Z}_{g,FC} \tag{14}$$

and $$X_{Cpe_i}(h_{fluid})+X_{Cpe_o}(h_{fluid})+\frac{X_{Cfluid}(h_{fluid})R_{fluid}(h_{fluid})}{X_{Cfluid}(x)+R_{fluid}(x)}=\frac{1}{1-\xi}\tilde{Z}_{g,FPC,0} \tag{15}$$

Then:

$$\tilde{Z}_{g,FC}=\frac{\frac{1}{\xi}\tilde{Z}_{g,FC}\frac{1}{1-\xi}\tilde{Z}_{g,FPC,0}}{\frac{1}{\xi}\tilde{Z}_{g,FC}+\frac{1}{1-\xi}\tilde{Z}_{g,FPC,0}}\Leftrightarrow \tag{16}$$

$$h_{fluid}=h_{electrodes}\frac{\tilde{Z}_{g,FC}(\tilde{Z}_{g,FPC,0}-\tilde{Z}_{g,FPC})}{\tilde{Z}_{g,FPC}(\tilde{Z}_{g,FPC,0}-\tilde{Z}_{g,FC})}$$

With this complex impedance measurement approach, the etching of the polymer with a FPC $h_{fluid}$ is calculated based on the initial values of the impedance of the FPC (FPC in air) and the adjacent FPC measurement. This does not solve the variations of the polymer electrical parameters vs. time.

Let us look at a frequency swipe method: for the same $h_{fluid}$ the frequency of the measurement of the AMA is changed within limits larger than the poles and zeros of the complex admittance.

For an FC:

$$\left.\begin{aligned}\tilde{Z}_{g,FC} &= \frac{1}{i\omega}\left(\frac{1}{C_{FC,fe_i}}+\frac{1}{C_{FC,fe_o}}\right)+\frac{R_{FC,fluid}}{1+i\omega\tau_{fluid}}\\ &\left(\frac{1}{C_{FC,fe_i}}+\frac{1}{C_{FC,fe_o}}\right)\triangleq\frac{1}{C_{FC,fe}}\end{aligned}\right\}\Rightarrow \tag{17}$$

$$\left.\begin{aligned}\tilde{Z}_{g,FC} &= \frac{1}{i\omega}\frac{1}{C_{FC,fe}}+\frac{R_{FC,fluid}}{1+i\omega\tau_{fluid}}\\ R_{FC,fluid}C_{FC,fe} &\triangleq \tau_{df}\end{aligned}\right\}\Rightarrow \|\tilde{Z}_{g,FC}\| =$$

$$\frac{1}{C_{FC,fe}}\frac{\sqrt{\omega^2\tau_{fd}^2+(1+\omega^2(\tau_{fluid}^2+\tau_{fluid}\tau_{df}))^2}}{\omega(1+\omega^2\tau_{fluid}^2)}$$

The measured absolute value of the impedance of the $FC$ has the poles and zeros placed at:

$$\omega_{pole}\in\left\{0,-\frac{i}{\tau_{fluid}},\frac{i}{\tau_{fluid}}\right\},\ \omega_{zero}\in\left\{-\frac{i}{\tau_{fluid}+\tau_{df}},\frac{i}{\tau_{fluid}+\tau_{df}}\right\} \tag{18}$$

with:

$$R_{FC,fluid}C_{FC,fe}\triangleq\tau_{df}$$

$$\tau_{df}=\varepsilon'_{dielectric}\rho'_{fluid}\frac{\ln\left(1+\frac{d_{electrodes}}{R_i+t_{dielectric}}\right)}{\ln\left(1+\frac{t_{dielectric}}{R_i}\right)\ln\left(1+\frac{t_{dielectric}}{R_i+t_{dielectric}+d_{electrodes}}\right)\ln\left(\left(1+\frac{t_{dielectric}}{R_i+t_{dielectric}+d_{electrodes}}\right)\left(1+\frac{t_{dielectric}}{R_i}\right)\right)}$$

From the bode plot of the absolute value of the complex impedance of an FC, one can extract $\tau_{fluid}+\tau_{df}$ and $\tau_{fluid}$ which is equivalent to resolving $\rho_{fluid}$ and $\epsilon_{fluid}$.

We will use the same procedure for extracting the parameters of the polymer within an FPC:

$$\tilde{Y}_{g,FPC}=\frac{1}{Z_{g,FPC,polymer}}+\frac{1}{Z_{g,FPC,fluid}}\Leftrightarrow \tag{19}$$

$$\tilde{Y}_{g,FPC}=\frac{1}{\frac{1}{\xi}\tilde{Z}_{g,FC}}+\frac{1}{\frac{1}{1-\xi}\tilde{Z}_{g,FPC,fluid}}\Leftrightarrow$$

$$Y_{g,FPC}=\frac{C_{FC,ee}\omega}{[\omega\tau_{df}-i(1+\omega^2\tau_{fluid}(\tau_{fluid}+\tau_{df}))]}$$

$$[\omega\tau_{dp}-i(1+\omega^2\tau_{polymer}(\tau_{polymer}+\tau_{dp}))]$$

$$\left\{\begin{aligned}&\xi[\omega\tau_{dp}-i(1+\omega^2\tau_{polymer}(\tau_{polymer}+\tau_{dp}))](1+\omega^2\tau_{fluid}^2)+\\&(1-\xi)[\omega\tau_{df}-i(1+\omega^2\tau_{fluid}(\tau_{fluid}+\tau_{df}))](1+\omega^2\tau_{polymer}^2)\end{aligned}\right\}$$

The poles and zeros for $\tilde{Y}_{g,FPC}$ can be estimated from the Bode plot $\|\tilde{Y}_{g,FPC}\|$, therefore one can extract $\rho_{polymer}$ and $\epsilon_{polymer}$ at any time during the measurement of the fluid.

Determination of Chemical Active Species Concentration

Let us consider an Admittance Measurement Array (AMA) as described above, with the following characteristics:

- Confines a (not necessarily) square array of $N_{cylinders}\times N_{cylinders}$ cylinders.
- 4 cylinders of the AMA are not covered with $Si_3N_4/SiO_2$ dielectrics and are used to measure (in air) the specifics of the dielectric covering the A1 electrodes ($\epsilon_{dielectric}$ $t_{dielectric}$).
- $N_{cylinder}=N_{FC,cylinder}$ cylinders (different from the 4 above) are not filled with any polymers.
- $N_{polymer}=N_{cylinders}\times N_{cylinders}-N_{FC,cylinder}-4$ are filled with $N_{polymer}$ different types of polymers.
- Every polymer is chemically sensitive to a specific chemical species within the fluid under test. For example, assume the fluid under test confines $N_{specie}$ active species with concentrations $C_{specie}$. The polymer in cylinder $k\in\leq\{1,\ldots,N_{polymer}\}\subset N$ reacts with the active species within the fluid. As a result of the reactions, the polymer will become soluble within the solution. The rate of solubility is related to the etching rate of the polymer with a function isomorphic with:

$$r_{ks}=m_{ks}(C_s-C_{ks,threshold})\theta(C_s-C_{ks,threshold}),\forall k=\{1,\ldots,N_{polymer}\},\forall s=\{1,\ldots,N_{species}\} \tag{20}$$

where:

- $r_{ks}$ Etching rate of polymer k reacting with specie s
- $\theta(C_s-C_{ks,threshold})$ Heaviside function of difference between active specie concentration Cs and concentration threshold Cks,threshold above which polymer k reacts with specie s
- $M_{ks}(C_s-C_{ks,threshold})$ Increasingly monotonic function describing the etching rate of polymer k by specie s of concentration $C_s$.

The total etch rate for polymer k while reacting to all species $N_{specie}$ within the fluid is the sum of the etch rate of the polymer per specie:

$$r_k=\sum_{i=1}^{N_{species}}r_{ks}=\sum_{i=1}^{N_{species}}M_{ki}(C_i-C_{ki,threshold}),\quad \forall k=\{1,\ldots,N_{polymer}\},\ \forall i=\{1,\ldots,N_{species}\} \tag{21}$$

with $M_{id}(C_i-C_{id,threshold})=m_{ks}(C_s-C_{ks,threshold})\theta(C_s-C_{ks,threshold})$.

The AMA structure is measured in air and the specifics of all Npolymer are stored as $(\epsilon_k,\rho_k,\tau_k)$, $\forall k=\{1,\ldots,N_{polymer}\}$.

The AMA structure immersed in the solution under test. We will assume at any time there is no concentration gradient of any active species at the surface of the AMA, therefore all cylinders "see" at the same time the same value of the concentration value for any species.

The admittance measurement circuit measures for every cylinder (Fluid Polymer filled Cylinders (FPF) and Fluid-filled Cylinders (FC)) at a sample rate S all complex admittances and calculates:

For every FC $$\left(\varepsilon_{FC,fluid,e'}^{(t_j)},\rho_{FC,fluid,e'}^{(t_j)},\tau_{FC,fluid,e}^{(t_j)}\right),\ \forall c=\{1,\ldots,N_{FC,cylinder}\},\quad \forall t_j=\left\{\frac{1}{S},\ldots,\frac{N}{S}\right\},N\in N$$

The average values of $(\epsilon_{FC,fluid}^{(t_j)},\rho_{FC,fluid}^{(t_j)},\tau_{FC,fluid}^{(t_j)})$ at time $t_j$:

$$\varepsilon_{FC,fluid}^{(t_j)}=\frac{1}{N_{FC,cylinder}}\sum_{i=1}^{N_{FC,cylinder}}\varepsilon_{FC,fluid,i}^{(t_j)} \tag{22}$$

-continued $$\rho_{FC,fluid}^{(t_j)} = \frac{1}{N_{FC,cylinder}} \sum_{i=1}^{N_{FC,cylinder}} \rho_{FC,fluid,i}^{(t_j)}$$

$$\tau_{FC,fluid}^{(t_j)} = \frac{1}{N_{FC,cylinder}} \sum_{i=1}^{N_{FC,cylinder}} \tau_{FC,fluid,i}^{(t_j)}$$

Based upon the values obtained above, assuming the fluid parameters within adjacent FC and PFC are the same (no concentration gradient at the surface of the AMA), calculate for every FPC $$\left(\varepsilon_{polymer,k}^{(t_j)}, \rho_{polymer,k}^{(t_j)}, \tau_{polymer,k}^{(t_j)}, h_{fluid,k}^{(t_j)}\right), \forall\, k = \{1, \ldots, N_{polymer}\},$$

$$\forall\, t_j = \left\{\frac{1}{S}, \ldots, \frac{N}{S}\right\}, N \in \mathbb{N}.$$

We can approximate the etching rate at time $t_j$ as:

$$\tilde{r}_k^{(t_j)} \approx \frac{h_{fluid,k}^{(t_j)} - h_{fluid,k}^{(t_{j-1})}}{t_j - t_{j-1}} = \left(h_{fluid,k}^{(t_j)} - h_{fluid,k}^{(t_{j-1})}\right)S, \quad (23)$$

$$\forall\, k = \{1, \ldots, N_{polymer}\}$$

Therefore for any time $t_j$ we get:

$$\tilde{r}_k^{(t_j)} = \sum_{i=1}^{N_{species}} M_{ki}(C_i - C_{ki,threshold}), \quad (24)$$

$$\forall\, k = \{1, \ldots, N_{polymer}\}, \forall\, i = \{1, \ldots, N_{species}\}$$

We can express the relation above in matrix form:

$\tilde{r}_{[N_{polymer},1]}^{(t_j)} = [\tilde{r}_k^{(t_j)}]$, measured etching rate matrix, at time $t_j$ $\tilde{C}_{[1,N_{specie}]}^{(t_j)} = [\tilde{c}_i^{(t_j)}]$, *concentration matrix at time* $t_j$, to be determined $C_{TH[N_{polymer},N_{specie}]} = [C_{ki,threshold}]$, concentrating threshold for polymer k reacting with specie I, known (25)

$M_{[N_{polymer},N_{specie}]}(C) = [M_{ik}(C_{ik})]$, etching rate function matrix for polymer k, reacting with specie i, known $C_{H[N_{polymer},N_{specie}]}^{(t_j)} = 1_{[N_{polymer},t]}\tilde{C}_{[1,N_{specie}]}^{(t_j)} - C_{TH[N_{polymer},N_{specie}]}$, normalized concentration matrix The systems of equations from (24) can be written as:

$$\tilde{r}_{[N_{polymer},t]}^{(t_j)} = M_{[N_{polymer},N_{specie}]}(C_{H[N_{polymer},N_{specie}]}^{(t_j)})1_{[N_{polymer},1]} \quad (26)$$

For the case of when the matrix $M_{[N_{polymer},N_{specie}]}$ is has an inverse, i.e., $N_{polymer} = N_{species} = N_e$, the equation reads:

$$\tilde{r}_{[N_e]}^{(t_j)} = M_{[N_e,N_e]}(C_{H[N_e,N_e]}^{(t_j)})1_{[N_e,1]} \quad (27)$$

And after some linear transformations becomes:

$$M_{[N_e,N_e]}(1_{[N_e,1]}\tilde{C}_{[1,N_e]}^{(t_j)} - C_{TH[N_e,N_e]})\tilde{r}_{[N_e,1]}^{(t_j)} = 1_{[N_e,1]} \quad (28)$$

This represents a system of $N_e$ equations $N_e$ unknowns $\tilde{C}_{[1,N_e]}^{(t_j)}$, which all have a unique solution, as long as the matrix $M_{[N_e,N_e]}$ is inverseable.

Although the invention is illustrated and described herein with reference to specific embodiments, the invention is not intended to be limited to the details shown. Rather, various modifications may be made in the details within the scope and range of equivalents of the claims and without departing from the invention.

The invention claimed is:

1. Apparatus for electrochemical analysis of fluids, comprising:

a chamber having a depth dimension for accommodating a volume of a fluid under test;

a first electrode disposed within said chamber and extending therewithin along said depth dimension;

a second electrode disposed within said chamber and extending therewithin along said depth dimension in laterally spaced relation with said first electrode; and a soluble solid disposed within said chamber between said first and second electrodes so as to substantially completely occupy a lateral gap therebetween to an extent of at least a portion of said depth dimension;

wherein a rate of dissolution of said soluble solid within said fluid is at least partially dependent on a chemical concentration of a corresponding analyte present in solution in said fluid.

2. An apparatus according to claim 1, wherein said soluble solid is an annealed polymer.

3. An apparatus according to claim 1, wherein said soluble solid substantially completely occupies said lateral gap between said first and second electrodes to a substantially full extent of a depthwise overlap between said first and second electrodes within said chamber.

4. An apparatus according to claim 3, wherein said soluble solid substantially completely fills said chamber from an uppermost extent thereof downward through said substantially full extent of said depthwise overlap.

5. An apparatus according to claim 1, wherein each of said first and second electrodes at least partially defines an interior wall of said chamber extending downward therewithin to an extent of a depthwise overlap between said first and second electrodes within said chamber.

6. An apparatus according to claim 5, wherein said first electrode is connected to ground and defines a substantially straight and cylindrically shaped wall extending downward within said chamber to said extent of said depthwise overlap, and said second electrode is connected to a power supply and defines a substantially straight and column shaped lateral wall extending substantially coaxially with said cylindrical lateral wall, and downward within said chamber to said extent of said depthwise overlap.

7. An apparatus according to claim 1, wherein said apparatus comprises a measurement tool including a silicon-based integrated circuit device defining an upper margin; and an array of grouped instances of said chamber, said first and second electrodes, and said soluble solid disposed along said upper margin to permit each of said instances of said soluble solid to be directly exposed to said fluid under test; said integrated circuit device further including an electrode selector unit for permitting said integrated circuit device to selectably individually apply a predetermined test signal to each paired instance of said first and second electrode, and to receive in response thereto an analog signal corresponding to a prevailing electrical condition within the corresponding instance of said chamber for use in determining said chemical concentration of said corresponding analyte present in solution in said fluid.

8. An apparatus according to claim 7, wherein said prevailing electrical condition is selected from the group comprising conductance, complex admittance, and complex impedance.

9. An apparatus according to claim 7, wherein said integrated circuit device further includes a measurement unit for determining a corresponding value of said prevailing electrical condition based on said analog signal response.

10. An apparatus according to claim 9, wherein said integrated circuit device further includes a data processor unit for controlling said electrode selector unit, receiving an analog signal from said measurement unit corresponding to said determined value of said prevailing electrical condition, and determining, based on said determined value of said prevailing electrical condition, a chemical concentration of said corresponding analyte present in solution in said fluid.

11. An apparatus according to claim 10, wherein said apparatus is adapted to determine said chemical concentration of said corresponding analyte present in solution in said fluid without absolute calibration.

12. An apparatus according to claim 10, wherein said integrated circuit device further includes an input/output data block for interfacing said integrated circuit device with at least one external device, including receiving and passing on to said at least one external device a digital signal from said data processor unit corresponding to a value of said chemical concentration.

13. An apparatus according to claim 7, wherein said integrated circuit further includes a control unit for controlling said test signal with respect to at least one of frequency and amplitude.

14. An apparatus according to claim 7, wherein with respect to said array of grouped instances, said instances of said soluble solid exhibit a plurality of variations of said soluble solid, each said variation being associated with a rate of dissolution within said fluid at least partially dependent on a respectively different chemical concentration of said corresponding analyte present in solution in said fluid.

15. An apparatus according to claim 7, wherein with respect to said array of grouped instances, said instances of said soluble solid exhibit a plurality of variations of said soluble solid, each said variation being associated with a rate of dissolution within said fluid at least partially dependent on a chemical concentration of a respectively different corresponding analyte present in solution in said fluid.

16. An apparatus according to claim 7, wherein upon a commencement of a dissolution of said soluble solid into said fluid, said apparatus remains operable for purposes of measuring a concentration of said analyte present in solution in said fluid at least until said soluble solid no longer substantially completely occupies said lateral gap between said first and second electrodes.

17. An apparatus according to claim 7, wherein said integrated circuit device includes a CMOS die, and said array of grouped instances is formed along said upper margin via an associated appropriate MEMS process.

18. An apparatus according to claim 17, wherein said MEMS process includes forming a metallic contact pattern along said upper margin for providing connectivity between said integrated circuit device and said array of grouped instances, and forming said paired first and second electrodes of each of said grouped instances via at least one instance of metallic deposition followed by an associated appropriate etch.

19. An apparatus according to claim 18, wherein forming said paired first and second electrodes of each instance of said grouped instances further includes at least one instance of depositing a material layer selected from the group consisting of $SiO_2$ and $Si_3N_4$, followed by an associated appropriate etch, wherein at least one instance of a chamber of said grouped instances is suitably masked to prevent said deposition of said material layer, and is further kept substantially free of any of said soluble solid, so as to permit said chambers of said at least one instance of a chamber to be utilized for control purposes during associated analyte concentration measurement sessions.

20. An apparatus according to claim 7, wherein at least one instance of a chamber of said grouped instances is kept substantially free of any of said soluble solid, so as to permit each chamber of said at least one instance of a chamber to be substantially entirely filled with said fluid under test and thereby utilized as a reference chamber for monitoring changes in electrical characteristics in said fluid under test during associated analyte concentration measurement sessions.

* * * * *